United States Patent [19]

Olson et al.

[11] Patent Number: 4,957,412

[45] Date of Patent: Sep. 18, 1990

[54] APPARATUS AND METHOD FOR SUPPORTING THE TORQUE LOAD ON A GAS TURBINE VANE

[75] Inventors: Rick A. Olson, Apopka; Perry E. Lowe, Altamonte Springs, both of Fla.

[73] Assignee: Westinghouse Electric Corp., Pittsburgh, Pa.

[21] Appl. No.: 240,292

[22] Filed: Sep. 6, 1988

[51] Int. Cl.[5] ..... F01D 25/24

[52] U.S. Cl. ..... 415/189; 415/190; 415/208.2

[58] Field of Search ..... 415/139, 189, 190, 209.3, 415/210.1, 208; 411/92, 75

[56] References Cited

U.S. PATENT DOCUMENTS

| | | | |
|---|---|---|---|
| 1,019,680 | 5/1912 | McGavock | 411/92 |
| 1,389,006 | 8/1921 | Noah | 411/92 |
| 3,841,787 | 10/1974 | Scalzo | 415/136 |
| 3,892,497 | 7/1975 | Gunderlock | 415/139 |
| 4,274,805 | 6/1981 | Holmes | 415/139 |
| 4,492,517 | 1/1985 | Klomdas | 415/139 |

FOREIGN PATENT DOCUMENTS

| | | | |
|---|---|---|---|
| 2430579 | 1/1975 | Fed. Rep. of Germany | 415/189 |
| 2532537 | 1/1977 | Fed. Rep. of Germany | 415/189 |
| 542197 | 12/1941 | United Kingdom | 415/139 |

*Primary Examiner*—Robert E. Garrett
*Assistant Examiner*—Hoang Nguyen
*Attorney, Agent, or Firm*—K. Bach

[57] ABSTRACT

A gas turbine of the type having turbine vanes retained in a cylinder and utilizing torque pins to transmit the torque load on the vanes to the cylinder is provided with improved structure for enabling insertion and withdrawal of the pin from engagement with the outer vane shroud in the vicinity of the cylinder flanges.

14 Claims, 4 Drawing Sheets

APPARATUS AND METHOD FOR SUPPORTING THE TORQUE LOAD ON A GAS TURBINE VANE

BACKGROUND OF THE INVENTION

1. Field of the Invention

This invention relates generally to the turbine section of a gas turbine, and more particularly to an apparatus and method for supporting the torque load on the turbine vanes.

Gas turbines employ a row of stationary vanes immediately upstream of each row of rotating blades to properly direct the hot gas flow to the rotating blades. A row of vanes comprises a plurality of vanes arrayed circumferentially around the flow path annulus. The vanes are retained in a turbine cylinder. To allow access to the turbine components, the turbine cylinder is split longitudinally into semi-circular upper and lower halves. The halves are joined together at horizontal joints by a plurality of bolts disposed along flanged portions of the cylinder halves extending the length of each cylinder.

Each vane comprises an airfoil, an outer shroud at its radially outboard end and an inner shroud at its radially inboard end. The flow of hot gas over the airfoil generates an axial force tending to urge the vane downstream. A support rail emanating radially from each outer shroud serves to restrain the motion of the vane in the axial direction by mating with the inner edge of a plate which is affixed at its outer edge to the turbine cylinder. Additional axial restraint may be obtained by a second support rail in the inner or outer shroud.

The flow of hot gas over the airfoil also generates a torque load on the vane, tending to urge it circumferentially around the turbine annulus. This load is absorbed by torque pins which engage the outer shroud support rail and transmit the load to the turbine cylinder. However, changes in the design of the turbine cylinder necessitated by the high temperature of modern gas turbines have made it impractical to use torque pins of the traditional type in the flanged area of the horizontal joints. This invention relates to a new type and method of using a torque pin which is suitable for use in the flanged areas.

2. Description of the Prior Art

In the past, torque pins were inserted and removed from outside of the cylinder through holes in the cylinder. This allowed the vanes to be removed without opening the turbine to disengage the pins. The pin was of cylindrical shape, a key being formed on one end adapted to engage a key-way in the vane outer shroud support rail. At installation the pin was inserted into the hole in the cylinder, pushing it radially inward until it engaged the vane. Since the diameter of the pin was only slightly smaller than that of the hole, the torque load on the vane was transmitted through the outer shroud and pin to the cylinder. A head formed on the end of the pin protruded through the hole in the cylinder and was seated in a counterbore on the outer surface of the cylinder. Motion in the radially outboard direction was prevented by a retainer bracket, affixed to the cylinder with screws, which spanned the head of the pin protruding from the cylinder, thus preventing the pin from accidentally disengaging.

In addition to the vanes, the turbine cylinder also contains a plurality of segments, arrayed around the turbine annulus, which form a ring encasing the tips of the rotating blades. To obtain optimum thermodynamic performance, the radial clearance between these segments and the tips of the rotating blades is maintained at a minimum. Hence, it is important that the turbine cylinder retain as nearly a perfectly cylindrical shape as possible. As a result of increases in the temperature of the hot gas flowing in the turbine cylinders of modern gas turbines, thermal stresses in the cylinder can cause it to ovalize and adversely affect the radial clearance between the segments and the rotating blades. To prevent this occurrence the thickness of the cylinder flanges and the diameter of the joint bolting has been increased and the spacing of the joint bolting has been decreased. As a result of these changes, however, there is insufficient clearance between the joint bolting to insert torque pins from outside of the cylinder to engage the vanes in the vicinity of the joint.

It is therefore desirable to provide an apparatus and method for transmitting the torque load on the vanes in the vicinity of the cylinder joint through pins which, although inserted in the turbine cylinder, do not interfere with the joint bolting and can be disengaged from outside the cylinder.

SUMMARY OF THE INVENTION

Accordingly, it is the general object of the present invention to provide a method and apparatus for transmitting the torque load on the turbine vanes to the turbine cylinder.

More specifically, it is an object of the present invention to provide a method and apparatus for transmitting the vane torque load to a turbine cylinder whose horizontal joints have been strengthened, resulting in insufficient access for traditional style torque pins in the area of the joint flanges.

It is another object of the invention to allow disengagement of the torque pins from outside of the cylinder.

Briefly, these and other objects of the present invention are accomplished in a gas turbine with a plurality of vanes, the vanes being subjected to a torque load and retained in a cylinder. Pins are utilized to transmit the torque load to the cylinder. The cylinder has horizontal joints in which the flange thickness and bolt diameter have been increased and the bolts spacing decreased such that there is insufficient access for insertion of the torque pins from outside of the cylinder.

In accordance with one aspect of the invention a hole is provided in the inner surface of the cylinder, in the vicinity of each flange, which extends through only a portion of the cylinder's thickness. A second, smaller hole, extends from the first hole to the cylinder outer surface penetrating through the section of the flange between horizontal joint bolts which is too narrow for the first hole to penetrate without interfering with the bolts. A short torque pin with a rod affixed to its end is inserted, from inside the cylinder, into the first hole, the rod penetrating through the second hole and extending beyond the outer surface of the flange. A nut, larger than the diameter of the second hole, is threaded onto the protruding end of the rod and prevents it from slipping back into the cylinder. After the vane is installed the torque pin is engaged by backing off the nut so that the rod and pin can be moved radially inward. After engagement of the pin, a bracket is attached to the cylinder outer surface in the vicinity of the second hole. This bracket prevents the rod, and hence the torque pin from which it emanates, from moving radially outward and thereby accidentally disengaging.

In accordance with another important aspect of the invention, the torque pins can be disengaged and the vanes removed from outside the cylinder by removing the retaining bracket and withdrawing the pin. This aspect of the invention eliminates the need to open the cylinder to remove the vanes, a time-consuming and costly operation.

In accordance with still another aspect of the invention, rotation of the nut on the rod can be used to apply mechanical force for withdrawing a pin in the event the pin becomes jammed in the engaged position.

DESCRIPTION OF THE PREFERRED EMBODIMENT

Figure 1:
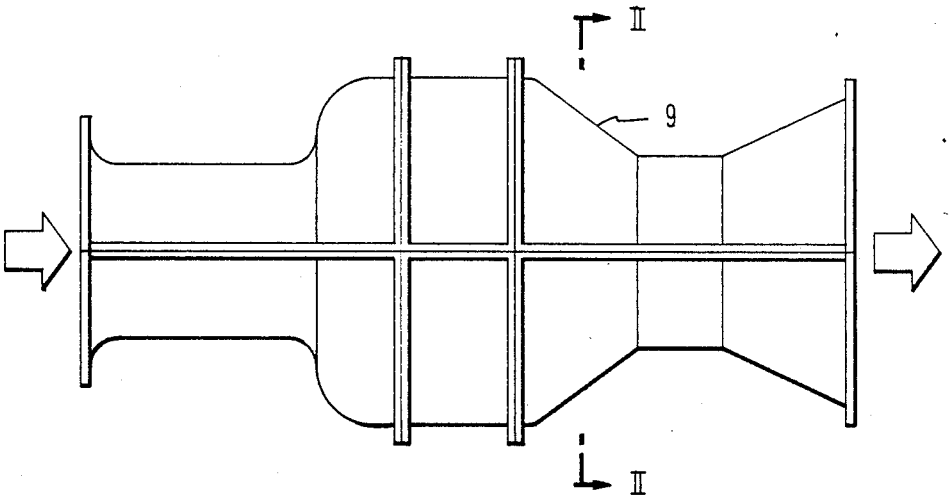
FIG. 1 is an elevation view of a gas turbine.
Figure 2:
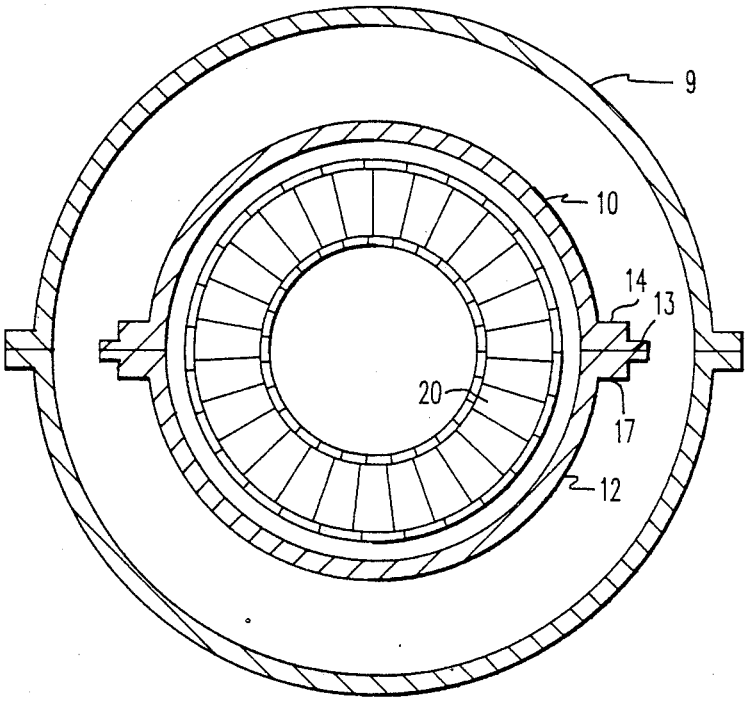
FIG. 2 is a cross-section of the turbine taken through line 2—2 of FIG. 1 showing the outer casing, turbine cylinder and a row of stationary vanes.
Figure 3:
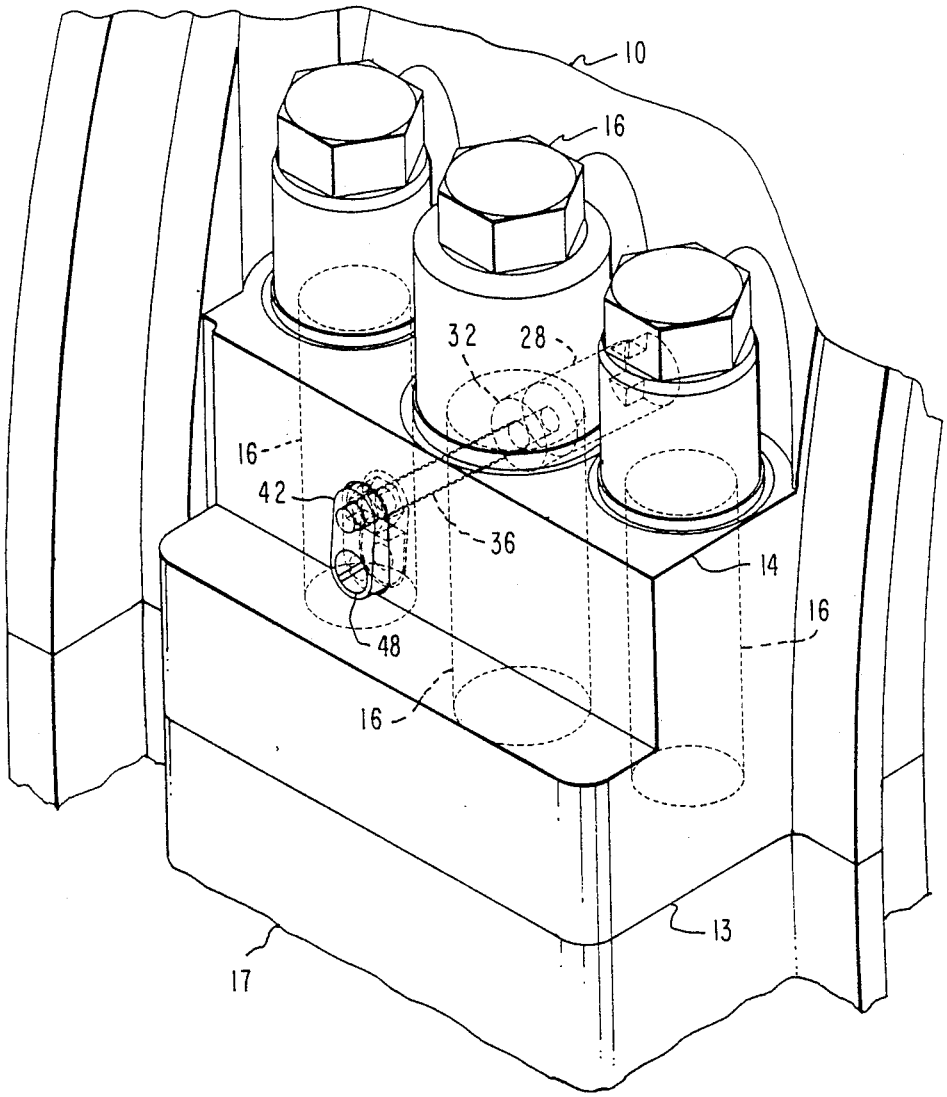
FIG. 3 is a perspective view of the horizontal joint area of the turbine cylinder viewed from outside the cylinder, showing the horizontal joint flange and bolts in the top half of the cylinder.
Figure 4:
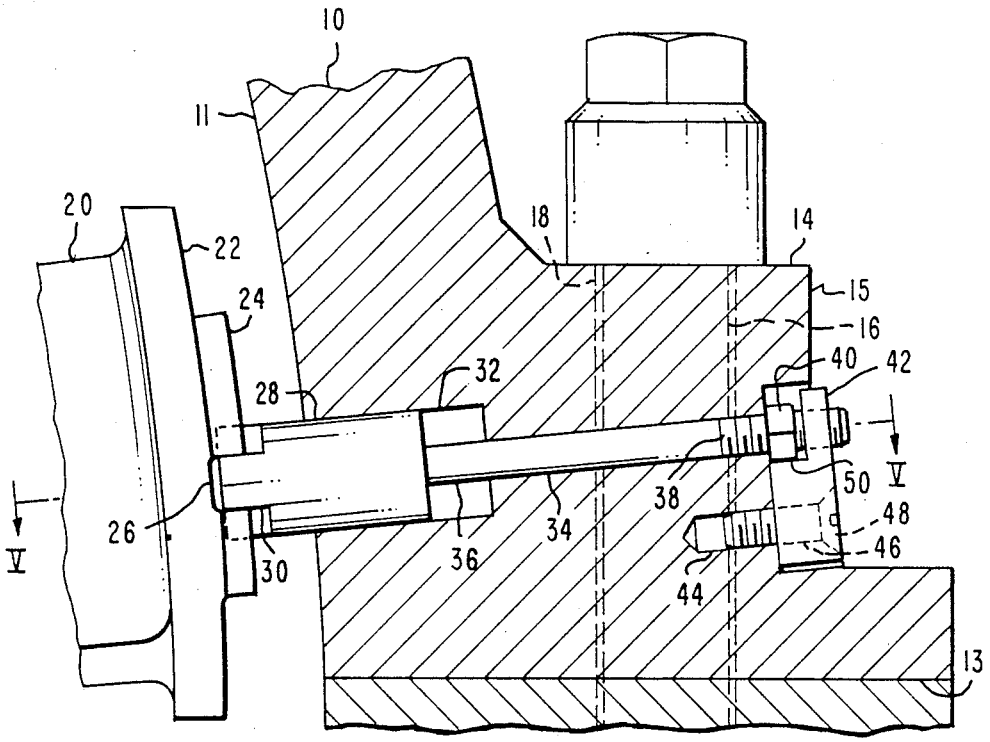
FIG. 4 is a vertical cross-section through a horizontal joint in the vicinity of a torque pin.

Referring to the drawings wherein like numerals represent like elements, there is illustrated in FIG. 1 a gas turbine, the arrows indicating the direction of flow through the turbine. FIG. 1 shows the outer casings of the gas turbine including the turbine outer casing 9. FIG. 2 shows the turbine outer casing 9, a turbine cylinder and a row of stationary vanes 20. The turbine cylinder is split longitudinally into upper and lower semicircular halves 10 and 12 joined along a horizontal joint 13. As shown in FIGS. 2 and 3 heavy flanges 14 and 17 emanate from the longitudinal edges of the cylinder halves. Large bolts 16 extend through holes 18 in the flange and serve to compress the flanged portions of the top and bottom cylinder halves together, as shown in FIGS. 3 and 4.

Figure 5:
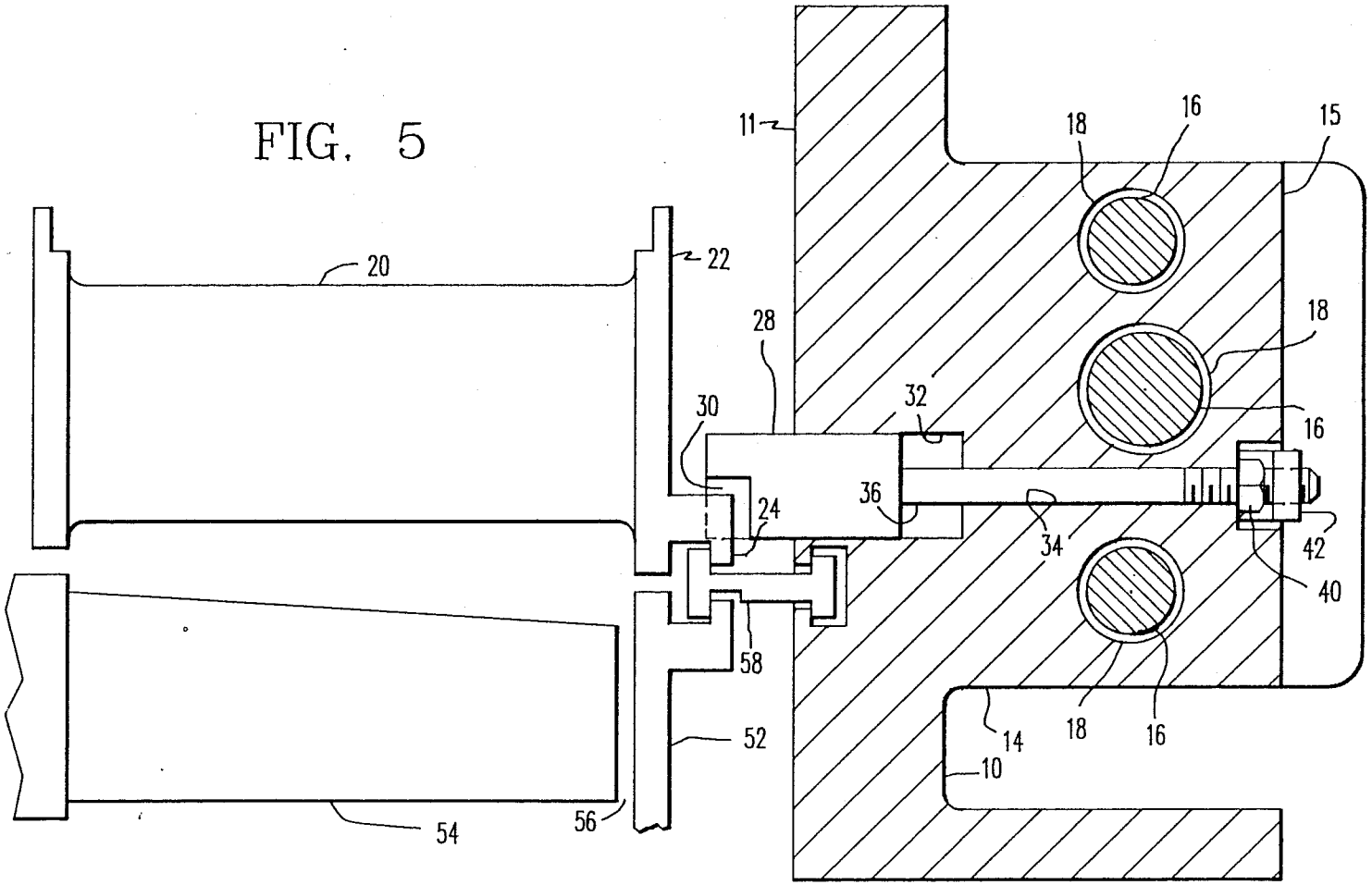
FIG. 5 is a cross-section taken through line 5—5 in FIG. 4.

Alternating rows of stationary vanes and rotating blades are retained inside the cylinder. The first row of vanes, shown in FIG. 2, is typical and is comprised of a plurality of vanes 20 arrayed circumferentially around the turbine flow path annulus. Referring to FIG. 5, it can be seen that at the radially outboard end of each vane is an outer shroud 22. A support rail 24 emanates from the outer shroud. The support rail is used to affix the vane to the cylinder and restrains motion of the vane in the axial direction. This is accomplished by mating the support rail with the inner edge of a plate 58, the plate being affixed at its outer periphery of the cylinder. Also retained in the cylinder are a plurality of segments 52 which form a ring encasing the tips of the rotating blades 54. To obtain optimum thermodynamic performance, the radial clearance 56 between these segments and the tips of the rotating blades is maintained at a minimum. A substantial loss of cylindricity in the cylinder will distort the shape of the ring formed by the segments 52 and result in insufficient clearance in the areas of the cylinder distorting radially inward (causing the blade tips to impact the segments) and excess clearance in the areas distorting radially outward (causing a loss in thermodynamic performance). Unfortunately, as a result of the high temperature of the hot gas in modern gas turbines, the cylinders are prone to distortion as a result of thermal stresses in the cylinder. To prevent this occurrence the thickness of the flanges at the horizontal joints and the diameter of the joint bolts have been significantly increased while the spacing of the bolts has been decreased. As a result, there is insufficient space between the bolts for a torque pin to be passed through the flange without interfering with the bolts. Hence the prior manner of utilizing torque pins, by inserting them from outside the cylinder through holes through the cylinder, is no longer practical for the vanes in the vicinity of the horizontal joints.

In accordance with the invention, this problem has been solved in the following manner. As illustrated in FIGS. 4 and 5, a first hole 32 is provided which extends radially from the inner surface of the cylinder 11 in the vicinity of each flanged portion of the cylinder. The hole penetrates through only a portion of the thickness of the flanged portion of the cylinder, stopping short before reaching the bolt holes 18. A second hole 34 extends from the bottom of the first hole within the cylinder to the outer surface 15 of the cylinder. Although there is insufficient clearance between bolt holes to allow the first hole to penetrate the entire thickness of the flanged portion of the cylinder, the second hole is of sufficiently small diameter to pass through the flanged portion of the cylinder between bolts without interfering with the bolts.

The torque pin 28, utilized in the vicinity of each of the flanged portions of the cylinder, is of cylindrical shape with a diameter slightly smaller than that of the first hole. A key 30 is provided on one end of the pin adapted to be inserted into a key-way 26 in a support rail 24 emanating from the outer shroud of the vane 22. In operation, the key is engaged in the key-way and the opposite end of the pin is disposed in the first hole, thereby transmitting the torque load on the vane through the outer shroud and pin to the cylinder.

A rod 36 emanates from the end of the pin opposite the key. At installation the pin is inserted into the first hole from inside the cylinder. The pin is oriented so that the key is facing radially inward and the rod penetrates through the second hole. The rod is sufficiently long to protrude from the outer surface of the cylinder when the torque pin is engaged. There is sufficient depth in the first hole 32 to allow the pin to be completely disengaged from the vane by withdrawing it radially outward. Thus, by grasping the end of the rod protruding from the outer surface of the cylinder the pin can be disengaged from outside the cylinder.

The end of the rod protruding from the cylinder features screw threads 38 thus allowing a nut 40 to be threaded onto the end of the rod. Since the face of the nut is larger than the diameter of the second hole 34, the nut prevents the pin from moving radially inward and slipping back into the cylinder when the vane into which it is engaged is removed. At installation the nut is rotated onto the rod so that it pulls the pin radially outward, into its disengaged position, holding it thus until the vane is installed. The nut also allows mechanical force to be applied for disengaging a jammed pin by rotating the nut after it has seated itself against the outer surface of the cylinder, thus drawing the rod radially outward.

A third hole 44 is drilled and tapped in the outside surface of the cylinder in the vicinity of each second hole. Accidental disengagement of the pin is prevented by installing a retainer bracket 42 utilizing a screw 48 disposed through a hole 46 in the bracket and threaded into the third hole 44. The retainer bracket has a relief 50 at one end whose depth is slightly greater than the height of the nut 40. A hole in the relieved portion, larger than the diameter of the rod but smaller than the nut, allows it to slip over the rod 36 but prevents the nut, and therefore the rod, from moving radially outward.

Although, for the purposes of illustration, the preferred embodiment of the invention has been described for use in the flanged portions of a turbine cylinder, the invention disclosed is applicable in any portion of a cylinder in which holes, of sufficient size to contain a pin capable of carrying the vane torque load, can not be provided through the entire thickness of the cylinder.

Many modifications and variations of the present invention are possible in light of the above techniques. It is therefore to be understood that within the scope of the appended claims, the invention may be practiced otherwise than as specifically described.

We claim:

1. A gas turbine comprising:

a plurality of vanes, each of said vanes having a radially outboard end, an outer shroud being formed on said radially outboard end, each of said vanes subjected to a torque load, said torque load on each vane transmitted to its said outer shroud;

a cylinder, said cylinder retaining said vanes therein in a circular array concentric with said cylinder;

a first hole in said cylinder, said first hole extending radially from the inner surface of said cylinder through only a portion of the thickness of said cylinder, whereby said first hole has a bottom within said cylinder;

a pin, said pin having a first and second end, said pin disposed in said first hole;

means for engaging said first end of said pin with one of said outer shrouds, whereby said torque load on said outer shroud is transmitted to said cylinder; and means for enabling the inserting and withdrawing of said pin from engagement with said outer shroud from outside of said cylinder.

2. Gas turbine according to claim 1 wherein said means for engaging said pin with said outer shroud comprises:

a support rail emanating from said outer shroud;

a key-way in said support rail; and a key formed in said first end of said pin, said key being insertable into said key-way.

3. Gas turbine according to claim 1, further comprising a second hole of smaller diameter than said first hole and extending radially from said bottom of said first hole to the outer surface of said cylinder, said means for enabling inserting and withdrawing of said pin coupled to said pin through said second hole.

4. Gas turbine according to claim 3 wherein said cylinder is split longitudinally into two semi-circular halves, each of said halves having two longitudinal edges along which said halves are joined, a flange formed by a portion of each of said cylinder halves along each of said longitudinal edges, said flanges in one of said halves mating with said flanges in the other one of said halves, a plurality of third holes being dispersed along each of said flanges, the longitudinal distance between each of said holes and the adjacent one of said third holes being less than the diameter of said first hole and greater than the diameter of said second hole, a bolt disposed in each of said third holes, said bolts compressing said mating flanges together, said first hole disposed along a radial line lying between two of said third holes, said bottom of said first hole disposed inboard of said third holes, said second hole disposed between said two of said third holes.

5. Gas turbine according to claim 4, wherein said means for enabling inserting and withdrawing of said pin comprises a rod, said rod having first and second ends, said first end of said rod emanating radially outward from said second end of said pin, said rod disposed in said second hole and having sufficient length so that said second end extends beyond the outer surface of said cylinder when said pin is engaged.

6. Gas turbine according to claim 5, further comprising means for preventing said pin from slipping back into said cylinder when said outer shroud, with which said pin is engaged, is removed from said cylinder.

7. Gas turbine according to claim 6, wherein said means for preventing said pin from slipping back into said cylinder comprises:

screw threads on said second end of said rod; and a nut threaded onto said end of said rod, the face of said nut being larger than the diameter of said second hole.

8. Gas turbine according to claim 7 further comprising means for restraining the motion of said pin in the radially outboard direction.

9. Gas turbine according to claim 8 wherein said means for restraining said pin in the radially outboard direction comprises:

a bracket, said bracket having a relieved portion, said relieved portion being slightly deeper than the height of said nut; and means for affixing said bracket to the outer surface of said cylinder such that said relieved portion extends over said nut.

10. Gas turbine according to claim 9 wherein a fourth hole is disposed in said relieved portion of said bracket, the diameter of said fourth hole being larger than the diameter of said rod and smaller than the diameter of said nut, said fourth hole slipping over said second end of said rod when said bracket is affixed to said cylinder. comprising means for restraining the motion of said pin in the radially outboard direction.

11. Gas turbine according to claim 5 further comprising means for applying mechanical force to withdraw said pin radially outward.

12. Gas turbine according to claim 11 wherein said means for applying mechanical force comprises:

screw threads on said second end of said rod; and a nut threaded onto said second end of said rod, the face of said nut being larger than the diameter of said second hole and bearing against the outer surface of said cylinder, whereby rotating said nut pulls said pin radially outward.

13. A gas turbine comprising:

a cylinder, said cylinder split longitudinally into semi-circular halves, each of said halves having two longitudinal edges along which said halves are joined;

a portion of each of said cylinder halves along each of said longitudinal edges forming flanges;

a plurality of vanes, said vanes retained circumferentially in said cylinder, each of said vanes having a radially outboard end, an outer shroud being formed on said radially outboard end, and a torque load being applied to each of said vanes when said turbine is in operation;

a first hole in each of said cylinder portions forming a flange, each of said first holes extending radially from the inner surface of said cylinder through only a portion of the thickness of said cylinder, each of said first holes having a bottom;

a second hole associated with each of said first holes, each of said second holes of smaller diameter then its respective first hole, each of said second holes extending radially from said bottom of its respective first hole to the outer surface of said cylinder;

a torque pin associated with each of said first holes, each of said pins having first and second ends, each of said torque pins disposed in its respective first hole;

means for engaging said first end of each of said torque pins with one of said outer shrouds; and a rod associated with each of said torque pins, each of said rods emanating from said second end of its respective torque pin, each of said rods disposed in one of said second holes, each of said rods having sufficient length to extend beyond said second hole when its respective pin is engaged.

14. In a gas turbine having a plurality of vanes, said vanes subjected to a torque load and retained in a cylinder, said cylinder split longitudinally into upper and lower halves, each of said cylinder halves having two longitudinal edges, said halves joined at said edges by flanged portions of said cylinder pressed together by bolts spaced along said flanged portions, a method for constructing said gas turbine to prevent loss of cylindricity in said cylinder due to thermal stresses, comprising the steps of:

providing a first hole in said cylinder in the vicinity of each of said flanged portions of said cylinder, each of said first holes extending radially from the inner surface of said cylinder through only a portion of said thickness of said cylinder, each of said first holes having a bottom;

providing a second hole for each of said first holes, each of said second holes extending from said bottom of its respective first hole to the outer surface of said cylinder, each of said second holes being parallel its respective first hole;

providing a pin for each first hole, each pin transmitting said torque load on one of said vanes to said cylinder, each of said pins having a first end adapted to engage one of said vanes and a rod emanating from a second end;

inserting said pins into said cylinder through said first and second holes from inside said cylinder, said rods entering said holes first and extending beyond the outer surface of said cylinder;

affixing onto the end of each of said rods first retaining means for restraining the motion of said rods in the radially inboard direction;

installing said vanes;

releasing said first retaining means thereby enabling said pins to move radially inward and engage said vanes;

affixing second retaining means onto the outer surface of said flanges in the vicinity of each of said second holes, said second retaining means restraining the motion of said rods in the radially outboard direction so as to prevent said pins from disengaging from said vanes.

* * * * *